US005992627A

United States Patent [19]

Lai

[11] Patent Number: 5,992,627

[45] Date of Patent: Nov. 30, 1999

[54] PACKING DEVICE FOR THE RECEIVING OF THE CHRISTMAS LAMP STRING

[76] Inventor: Chong Yung Lai, No. 188, Hsien Chang Second Road, Chu-Pai City, Hsinchu Hsien, Taiwan

[21] Appl. No.: 09/178,748

[22] Filed: Oct. 27, 1998

[51] Int. Cl.[6] ..... B65D 85/42

[52] U.S. Cl. ..... 206/418; 206/702; 220/4.26

[58] Field of Search ..... 206/418, 419, 206/388, 702, 420; 242/405.1, 405.2, 405.3, 580; 220/4.01, 4.26

[56] References Cited

U.S. PATENT DOCUMENTS 1,802,104 4/1931 Bilger et al. ..... 242/580
5,695,148 12/1997 Christensen ..... 242/405.3
5,722,613 3/1998 Michael ..... 242/600
5,868,334 2/1999 Cedillo ..... 206/420

*Primary Examiner*—Paul T. Sewell
*Assistant Examiner*—Nuan T. Lam
*Attorney, Agent, or Firm*—Rosenberg, Klein & Lee

[57] ABSTRACT

The present invention relates to a packing device for the receiving of the Christmas lamp string. It is to provide the Christmas lamp string after usage to be easily wound around the outer edges of connecting columns mainly by the positioning disks of both sides with the connecting columns binding together to achieve the purpose of receiving packing. Thus, it is very convenient to be taken out for usage next time. It is able to improve the disadvantage of hard to store the lamp string in the pass, and increase the practical effects.

1 Claim, 4 Drawing Sheets

PACKING DEVICE FOR THE RECEIVING OF THE CHRISTMAS LAMP STRING

BACKGROUND OF THE INVENTION

Ordinary Christmas lamp strings mainly utilize the packing frames to clip-set the orderly arranged Christmas lamps and electrical wires to the frames, and pack them in carton for sale. After being bought by the users, the Christmas lamp strings are taken out and hanged for the usage of decoration. Then, after the festival has passed, the lamp string was taken off for the next usage. The lamp strings taken off are easily to have their lamp groups and electrical wires be wound together, and the users are hard to put the lamp strings back to the frames which they buy. Therefore, it will cause great troubles to the users who are intended to reuse the lamp strings, e.g. the lamp strings are hard to be pulled out, or the lamps drop out while being pulled out, the lamp strings become out of order, and are unable to be used.

Owing to the above described, the main object of present invention is to provide a temporarily receivable packing structure of the Christmas lamp string, such that the lamp string can easily be wound-stored and pulled out for use, therefore it is a invention of progressiveness.

BRIEF DESCRIPTION OF THE DRAWINGS

By referring to the following drawings, the features and effects of the present invention are illustrated below.

DETAILED DESCRIPTION OF THE PREFERRED EMBODIMENT

Figure 1:
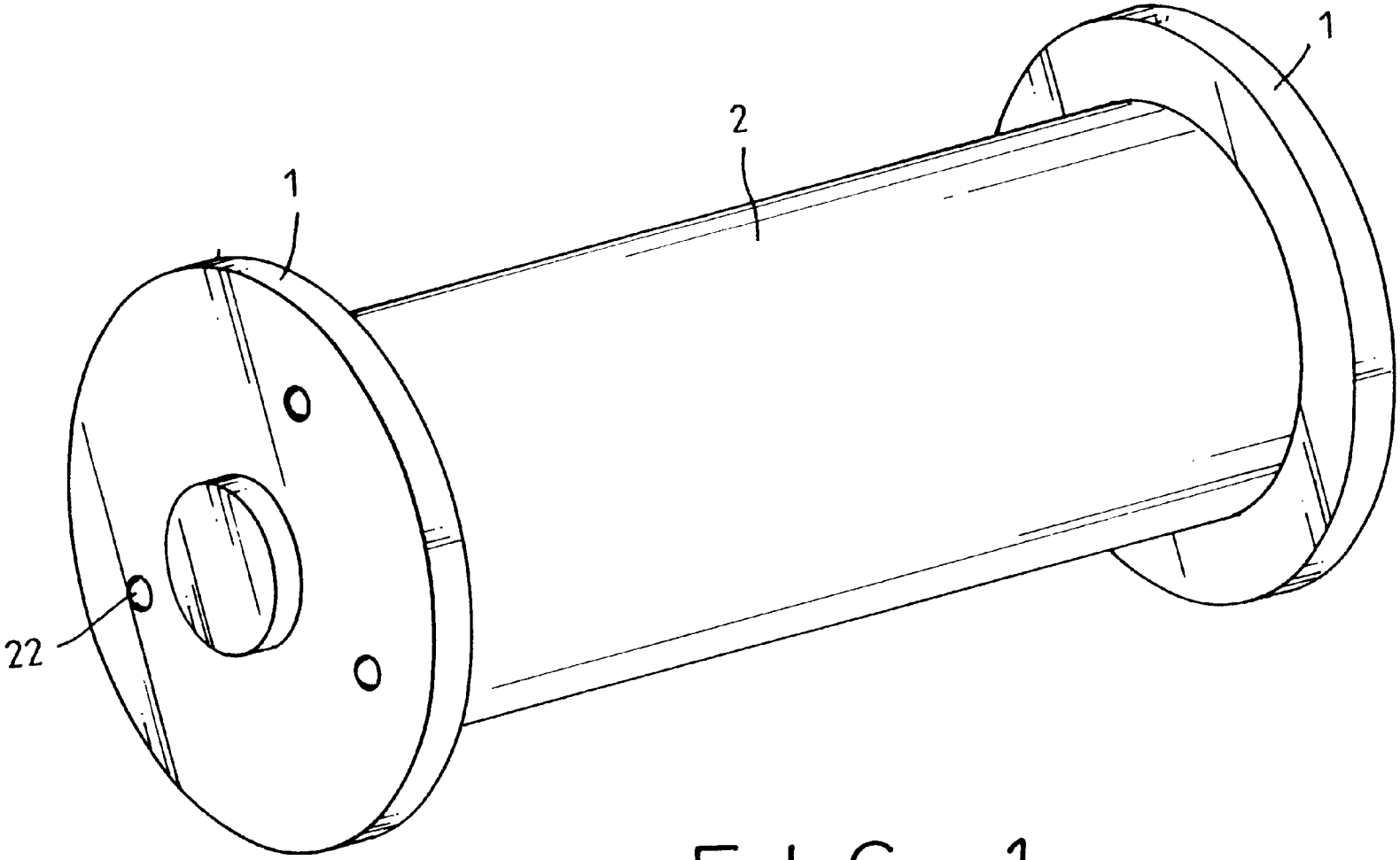
FIG. 1 is a perspective view of the present invention.
Figure 2:
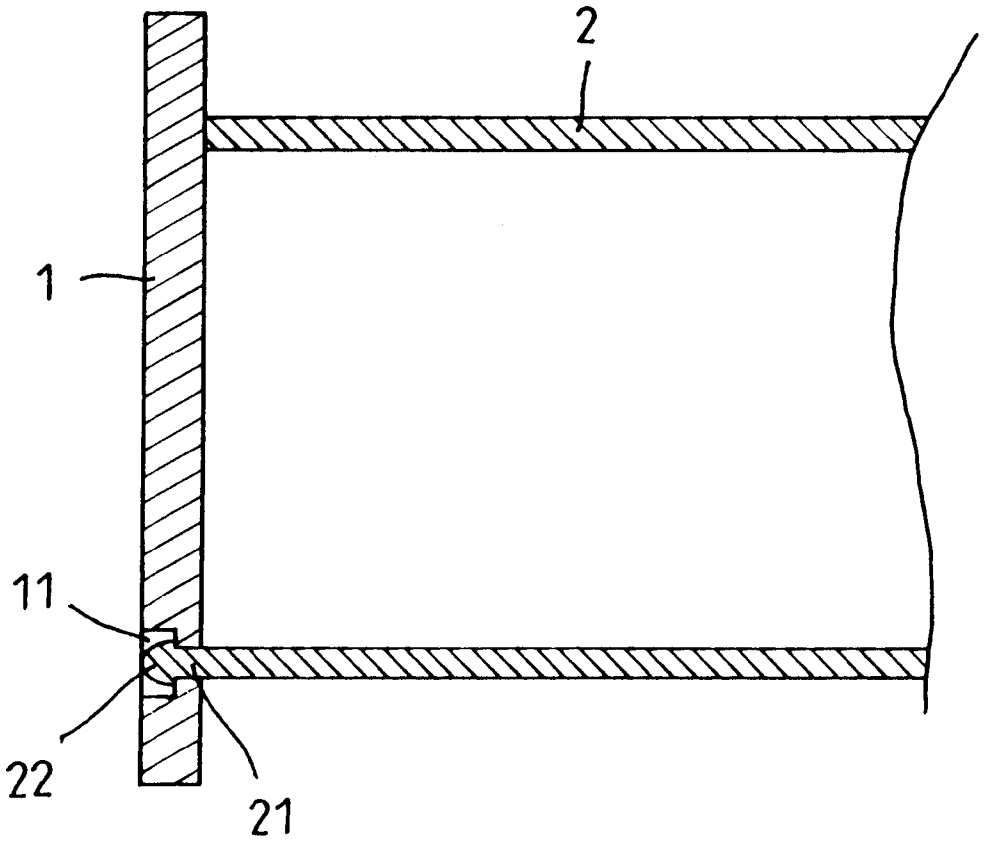
FIG. 2 is a partially sectional view of the present invention.

Referring to those shown in FIG. 1 and FIG. 2, the present invention mainly is including two opposite positioning disks (1) having several opened holes (11) with non-equal diameters in the positioning disks (1), which their outside holes' diameters are larger than inside diameters. A connecting column (2) with multiple groups of protruded portions (21) at both ends, and the outer ends of protruded portions (21) are set as the semi-spheres (22). The diameters of semi-spheres (22) are slightly larger than the inside diameters of the opened holes (11) and smaller than the outside diameters of opened holes. Each protruded portion (21) is set relatively to each opened hole (11) of the positioning disks (1). Therefore it can be clipped into each opened hole (11) to form a firmly engaged status as shown in FIG. 2, such that the two positioning disks (1) are connect-set by middle connecting columns (7) to form as a whole body structure.

Figure 3:
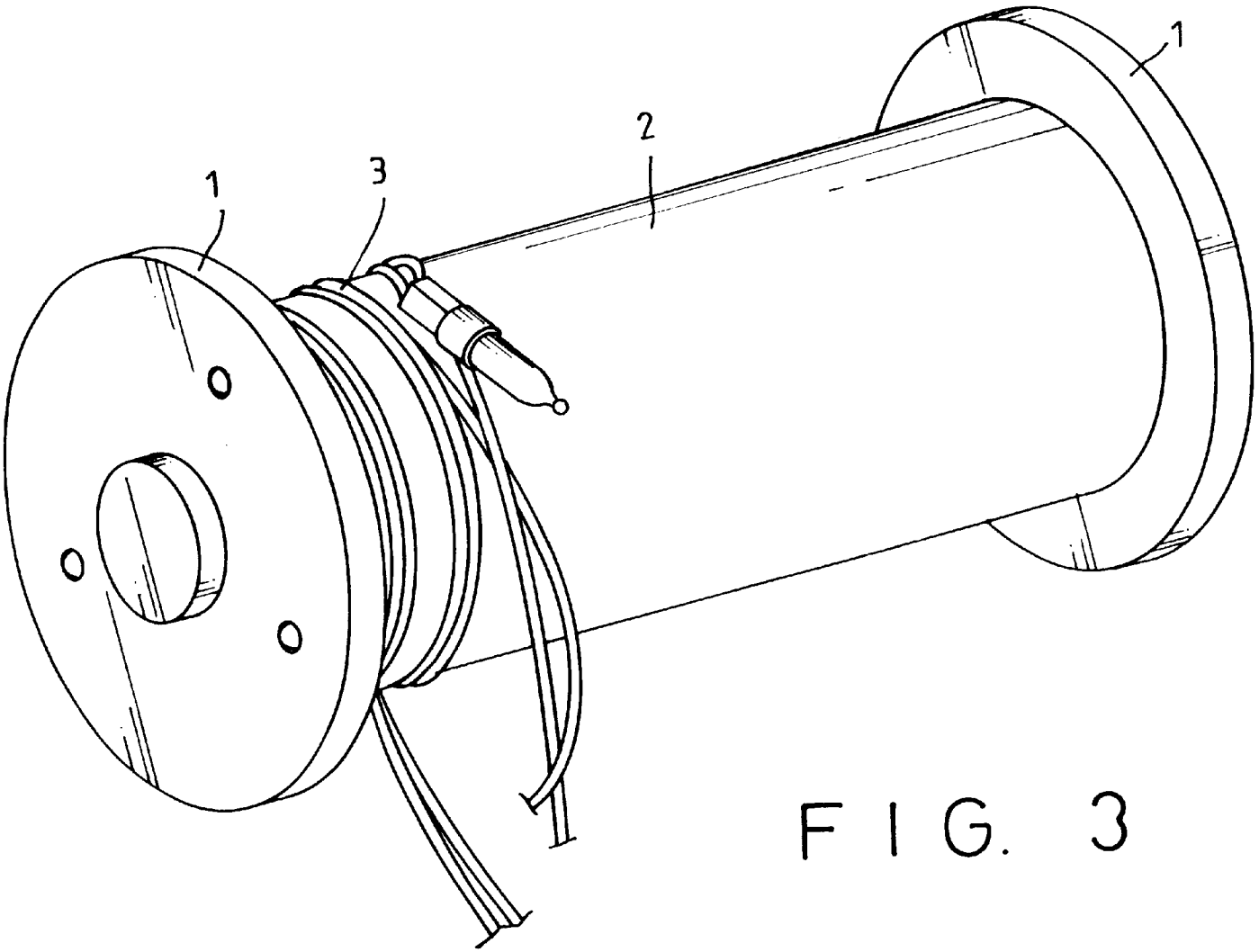
FIG. 3 is a view of the present invention.

When the users wind the lamp strings (3) directly around the outside of connecting columns (2) as shown in FIG. 3, the lamp strings (3) can be easily to be received temporarily to the outer portions of the connecting columns (2) between two positioning disks (1). And due to this direct sequential winding around, the lamp strings (3) cab be reverse-taken out easily for the next usage without difficulty. Thus, the positive objects of the present invention's design can be achieved.

It is to be understood through the above-described structure that the device combination of the present invention apparently can be easily assembled by the very simple and crafty structure, and is able to provide a very convenient usage to solve the conventional receiving trouble after using the lamp strings. Thus, the present invention has the necessary conditions of granting the patents.

Figure 4:
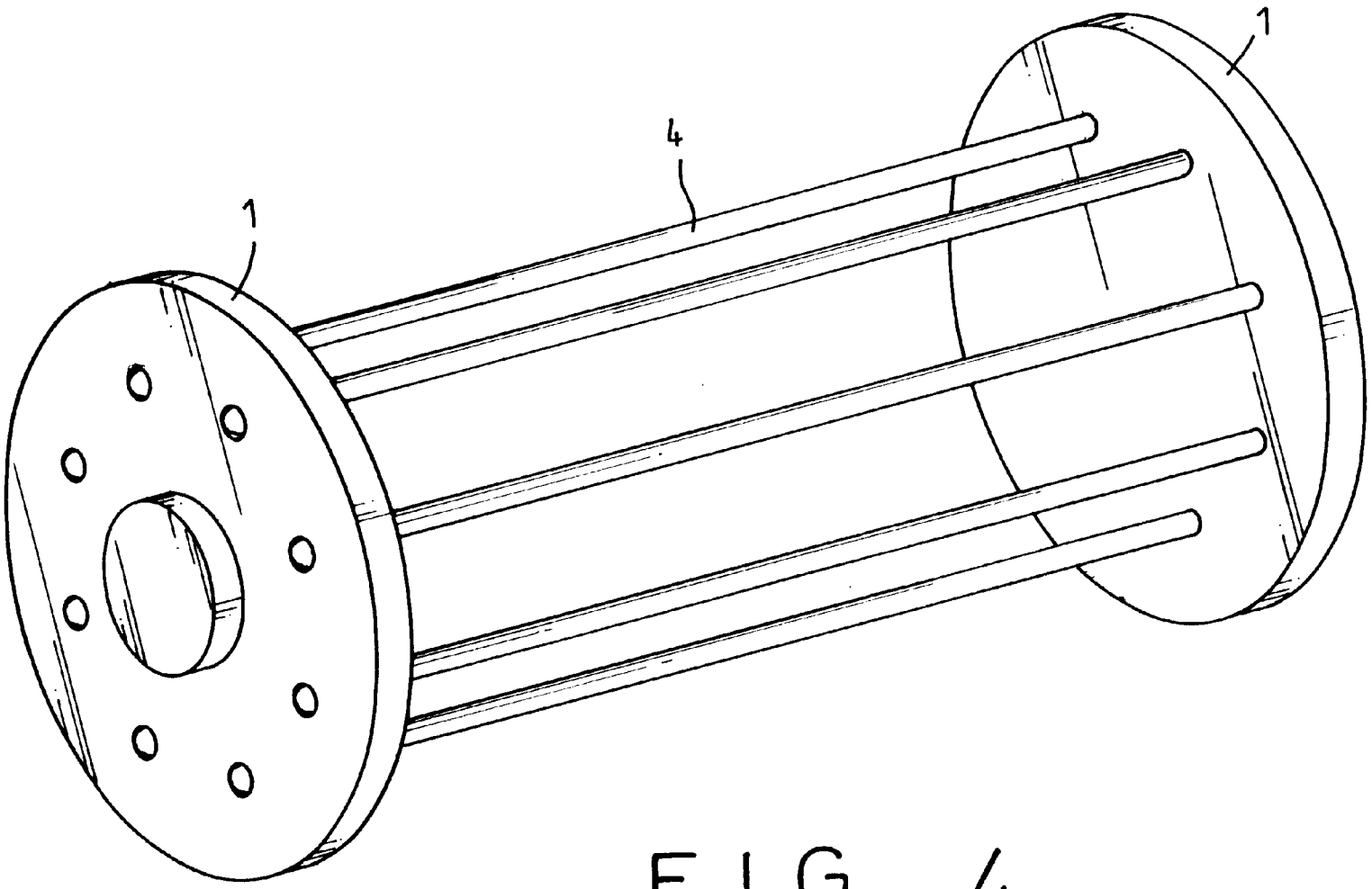
FIG. 4 is a structural perspective view of a variation of the present invention.

As shown in FIG. 4, is a variational example of an application of the present invention, i.e., is including the feature of positioning disks (1) at both ends. Multiple groups of connecting rods (4) are set in the middle with both ends clip-engaged directly with the positioning disks (1) to form as a combined design of similar effects. This is what the present application claims. That is to say, the spirit of the present invention is to provide a design, which includes two positioning disks and any connecting structures in between, and can easily be clip-engaged. Thus, any changes and modifications under this inventive idea are still within the scope of the following claims.

What is claimed is:

1. A packing device for receiving a Christmas lamp string, comprising:

a pair of positioning disks disposed in spaced relationship, each of said positioning disks having a plurality of holes formed therethrough, each of said plurality of holes having an outside opening with a diameter larger than a diameter of an inside opening thereof; and, a connecting column disposed between said pair of connecting disks for winding a lamp string thereon, said connecting column including a plurality of protruding portions extending from opposing ends thereof in respective alignment with said plurality of holes of each of said pair of disks for coupling therewith, each of said protruding portions having an outer end being formed as a semi-sphere having a diameter slightly larger than said diameter of said inside opening of a respective one of said holes and smaller than said diameter of said outside opening of said hole.

* * * * *